United States Patent [19]

Ferreira-Godinho

[11] Patent Number: 4,693,626

[45] Date of Patent: Sep. 15, 1987

[54] FOLDER FOR PAPER SHEETS, ESPECIALLY EDP PAPER SHEETS

[76] Inventor: Manuel Ferreira-Godinho, Bergiusweg 10, D-3250 Hameln 1, Fed. Rep. of Germany

[21] Appl. No.: 920,255

[22] Filed: Oct. 16, 1986

[30] Foreign Application Priority Data

Oct. 17, 1985 [DE] Fed. Rep. of Germany ..... 3537026

[51] Int. Cl.[4] ..... B42F 3/00; B42F 13/14; B42F 11/00; B42F 13/00

[52] U.S. Cl. ..... 402/73; 402/17; 402/68; 402/75

[58] Field of Search ..... 402/8, 46, 17, 48, 56, 402/58, 60, 68, 63, 70, 73, 75, 79, 80 R; 281/21 R, 29; 312/184, 185

[56] References Cited

U.S. PATENT DOCUMENTS

| | | | |
|---|---|---|---|
| 2,439,826 | 4/1948 | Snyder | 402/68 |
| 3,080,562 | 3/1963 | Potts et al. | 402/17 |
| 3,224,450 | 12/1965 | Whittemore et al. | 402/68 |
| 3,263,689 | 8/1966 | Lindgren et al. | 402/17 |
| 4,527,923 | 7/1985 | Waldman | 402/75 |

FOREIGN PATENT DOCUMENTS

| | | | |
|---|---|---|---|
| 973442 | 8/1975 | Canada | 402/17 |

*Primary Examiner*—E. R. Kazenske
*Assistant Examiner*—Heyrana, Paul M.
*Attorney, Agent, or Firm*—Andrus, Sceales, Starke & Sawall

[57] ABSTRACT

A folder (20) for paper sheets, especially EDP paper sheets (32), which have at least two spaced punched holes (34) at their lateral margins, is disclosed. A carrier body (21) is provided with resilient line-up pins (36) for accommodating paper sheets (32). Retaining means (38, 40) serve to fixedly secure the line-up pins (36) and the paper sheets (32). The line-up pins (36) are secured with one end thereof to the carrier body (21). The retaining means (38, 40) comprise telescope-type clamping bars (38) for receiving the other ends of the line-up pins (36). The carrier body (21) is an integral injection moulded part which constitutes bottom part (22), back (24) and top part (26) in a stable unit.

15 Claims, 10 Drawing Figures

FOLDER FOR PAPER SHEETS, ESPECIALLY EDP PAPER SHEETS

BACKGROUND OF THE INVENTION

The invention is directed to folders for paper sheets, especially EDP paper sheets, the lateral margins of which respectively include at least two spaced punched holes, comprising a carrier body which is provided with resilient line-up pins for receiving the paper sheets through the punched holes, and comprising retaining means for fixing the line-up pins and the paper sheets.

Such folders are commercially available and are used, for instance, to accommodate computer-printed lists, programmes, evaluations or the like. The paper sheets may either be discrete paper sheets or stacks of zig-zag folded paper sheets. To this end the feed holes, which are in any case provided on the sheet margins, may be utilized.

FIG. 1 schematically shows a conventional folder 10 of the specified type. A stack of broadside paper sheets 12 will be apparent which are provided with equi-distant punched holes 13 on the margins thereof. Line-up pins or sheet retainers 16 are passed through the extreme outer punched holes 13, said line-up pins or sheet retainers also passing through holes 15 formed in a clamping bar 14. A respective slider 17 is pushed onto both ends of the clamping bar 14, the slider interior accommodating the projecting end of the line-up pin or sheet retainer 16 and turning it down when pushed towards the clamping bar 14.

To cover the paper sheets 12 the known folder 10 comprises a soft cover sheet 18 of synthetic material which is joined to the clamping bar 14. The bottom side of the assembly, which is not illustrated in FIG. 1, is similarly configured. The line-up pins or sheet retainers 16 have knitting-needle shape of any desired length and their two ends are turned down by the respective sliders 17. The bottom side of the assembly is provided with a further clamping bar 14 for accommodating the line-up pins or sheet retainers 16.

Such folders 10 of conventional design have, however, a number of drawbacks. As the cover sheets 18 are made from soft, thin material, such folders 10 can only be stored in horizontal position, because they have no stability. But since the back region of the folder 10 is thicker than the opposite side, a wedge-like body results, and several such bodies can be stacked only with difficulty because the oblique stack will easily start sliding.

Moreover, there is not only one size of paper sheets, especially of EDP paper sheets, but there exist different sizes. Both upright sizes having punched holes along the longitudinal sides and broadside sizes having punched holes along the transverse sides are known. In addition to that, the dimensions in longitudinal and transverse directions are also by no means uniform. Even though the usual EDP paper sheets have almost DIN-A4 size, the standard dimensions thereof, which are 210 mm $\times$297 mm, are normally not satisfied. Rather, there are upright sizes having a height of 305 mm and a width of 235 mm, 240 mm and 250 mm. In the case of broadside sizes, these have a height of 203 mm and 228 mm and a width of 305 mm, 315 mm and 322 mm.

With the conventional folder of the above-described kind, this fact is taken into account by providing the clamping bar 14 at the ends thereof with a plurality of spaced holes 15 so as to achieve an adaptation to the paper sizes. But an adaptation is possible only to a slight extent; a folder designed for EDP upright sizes cannot be used for EDP broadside sizes, and vice versa, because the differences in length of the clamping bars would be far too great.

But the adaptation of a folder within the range of the respective upright sizes, on the one hand, and broadside sizes, on the other hand, is quite difficult. The clamping bar 14 must in any case have the length of the maximum EDP paper size. When EDP paper sheets of somewhat smaller dimensions are to be filed, the line-up pins or sheet retainers 16 may be re-positioned as indicated in FIG. 1, but in that case the clamping bar 14 will clearly project beyond the stack of paper sheets 12 at least on one side thereof. While this results in an unsightly appearance, there is also a risk of injury to the user.

The FR-PS No. 2,095,449 discloses a similar folder of the specified kind, which comprises a bottom and a top as loose discrete parts which simultaneously constitute clamping bars. To this end bottom and top include mutually opposite pairs of openings for receiving line-up pins or sheet retainers, one of said pairs of holes being constituted by slots to provide some possibility of adjustment to paper sheets of different width. But this does not result in a stable asembly, because the folder has no back and there is only a loose connection between bottom and top by the line-up pins or sheet retainers themselves. Moreover, the punched holes of the paper sheets are subjected to high loads in such a known folder and may easily suffer damage or be torn out, because the line-up pins themselves are but loosely arranged in the slots and insufficiently secured. Moreover, this known assembly is unsightly because there is no back at all. In practical use, the adjusting facilities are quite insufficient, because only one size can be accommodated in the assembly. A selective accommodation of broadside and upright sizes is not possible with the known assembly. When paper sheets are to be added or removed, the assembly must be taken apart, and the top must be removed completely.

The DE-GM No. 1,983,046 describes a top bar for arrangements for lining up perforated records, said top bar comprising two relatively displaceable bar portions to thereby adjust the overall length of the top bar to the respective application. The DE-GM is silent about the problem of accommodating paper sheets of quite different sizes in one and the same folder and also about the storage of the folders themselves in such a way as to eliminate storage problems.

It is therefore the object of the instant invention to provide a folder for paper sheets, especially for EDP paper sheets, which may be readily stored and ensures the protected accommodation of paper sheets and is suitable for upright-size and broadside-size paper sheets, and which provides for simple and versatile adaptation to different dimensions of the paper sheets.

SUMMARY OF THE INVENTION

The solution according to the invention resides in designing a folder of the above-specified kind in such a way that the carrier body or cover is an integral injection moulded part constituting a bottom part, a back and a top part in a stable unit, that the bottom part of-the carrier body or cover include holes arranged along two lines which are normal to each other, in which holes line-up pins or sheet retainers are mounted for re-positioning thereof, and that the retaining means include telescope-type clamping bars which accommodate include protruding ends of the line-up pins or sheet retainers and are provided separately from the top part.

According to the invention a single folder suffices for all of the conventional standard sizes, for instance quasi-DIN-A4 sizes. Upon conversion from larger-size to smaller-size paper sheets the clamping bar will not project beyond the stack of paper sheets, because the clamping bar is merely telescoped so that any risk of injury is eliminated. There will be no storage problems in respect of the folders of the invention, because these folders can be placed in filing structures in the usual way and may have usual height dimensions like standardized office folders. The folder according to the invention is quickly converted in case other paper sizes are to be accommodated.

Suitably, the integral carrier body or cover and the retaining means or, respectively, the parts thereof are made of synthetic material, especially of a polyolefin. Polypropylene is especially suitable so that these parts may be made as injection moulded parts. The line-up pins or sheet retainers likewise are suitably made of synthetic material for imparting a certain elasticity thereto, suitably they are made of polyamide.

Advantageously, the holes are provided in parallel to the edges of a rectangular bottom part and are disposed at a predetermined spacing, especially at the spacing of the feed holes of EDP paper sheets. As certain paper sizes have already been generally accepted for EDP paper sheets, a relatively small number of holes will suffice which are arranged in the vicinity of three corners of a bottom part.

Advantageously, the holes are configured in the bottom part of the carrier body or cover as integrally formed blind holes which are provided on the outer surface of the bottom part of the carrier body with webbings adapted to be perforated. Thereby the folder presents an essentially smooth exterior, and the line-up pins or sheet retainers can, if required, be pushed through the webbings so that the line-up pins or sheet retainers are passed therethrough and are retained by clamping action in the bottom part.

According to a specific embodiment the holes formed in the bottom part on the outer surface of the carrier body or cover are provided with countersunk portions for receiving a respective head of the line-up pins, and the nail-like line-up pins are provided in the vicinity of their heads with areas of greater friction for friction-tight insertion in the carrier body. When the line-up pin has been inserted, its head will not protrude towards the outside and the line-up pins will be securely retained in the carrier body or cover.

As a further development of the folder according to the invention the telescope-type clamping bar comprises two telescoping injection moulded parts the outer ends of which are respectively provided with a through-bore for receiving a line-up pin or sheet retainers and with a receiving portion for receiving a push-on or push-in slider for locking the line-up pins or sheet retainers. In this connection a respective single bore at the two outer ends of the clamping bar will be sufficient.

The telescope-type clamping bar is provided on its one part with a guide opening into which the other part may be inserted with a projecting portion of complementary cross-section, the two parts being relatively displaceable while in frictional engagement. The cross-sections of guide opening or projection may be selected to be round, circular or oval but may also be rectangular. What is of importance in this connection is that the two parts of the clamping bar have a sufficiently large overlapping region so that both parts may be retracted and extended over a large area. In one embodiment, the guide opening of the clamping bar is a through-bore and receives a bar-like projection in the interior thereof. In another embodiment the guide opening is a U-shaped groove provided on the upper surface thereof with inwardly facing retaining legs. In a further embodiment the guide opening is constituted by a ring provided on the one part of the clamping bar, said ring engaging about the insertable projection of the other part.

Suitably, each part of the clamping bar has at least an elastic protruberance respectively positioned along the same line of movement, said protruberances forming abutments to retain the clamping bar from being pulled completely apart. Undesired disengagement of the two parts is thereby prevented.

It is especially suitable when the receiving portions for the sliders have the same cross-sectional profile as the guide opening for receiving the projection of the telescope-type clamping bar. In particular, the one part of the telescope-type clamping bar may be a continuous U-shaped section member formed on the upper surface thereof with inwardly facing retaining legs. This facilitates manufacture of the assembly, and the clamping bar itself has a uniform, attractive appearance especially when telescoped.

Furthermore, it is advantageous when the top part is provided with an additional line-up mechanism on the outer edge of its inner side facing the bottom part. This additional line-up mechanism serves to accommodate notes and additional information recorded on normal paper sheets which do not have punched holes like the EDP paper sheets.

BRIEF DESCRIPTION OF THE DRAWINGS

Below, the invention will be explained also in respect of further features and advantages with reference to the description of embodiments thereof and to the accompanying drawing, in which.

DESCRIPTION OF PREFERRED EMBODIMENTS

Figure 1:
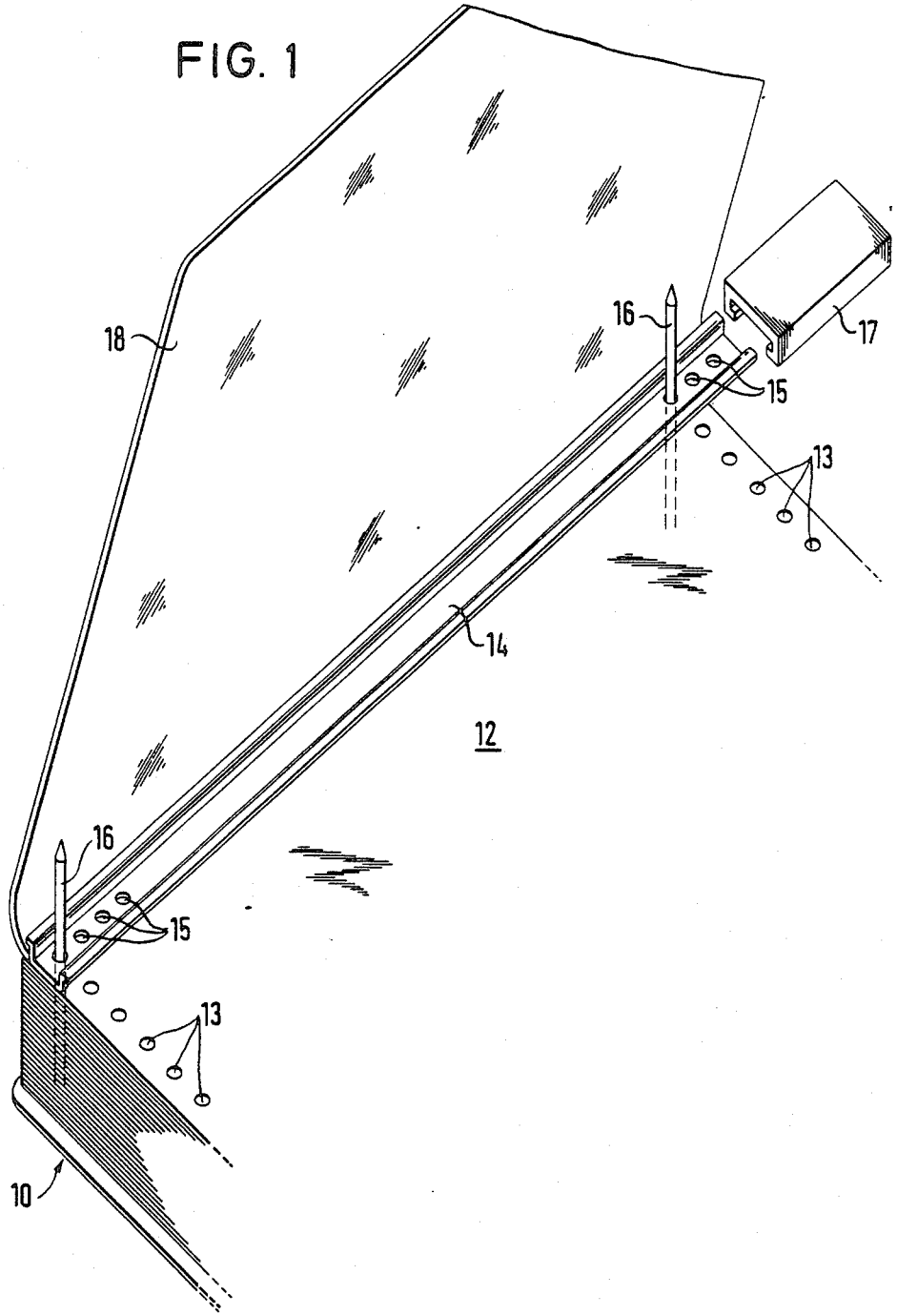
FIG. 1 is a perspective view of a conventional folder.

The basic structure of the folder of the invention will be apparent from FIGS. 2 to 4, to which reference shall be made hereinbelow. The folder is generally indicated at 20 and comprises a carrier body or cover 21 which at least a bottom part 22 and preferably also a back 24 and a top part 26 which are joined to each other by permanently foldable creases 23 and 25. A handling hole 28 is formed in the back 24. The outer margin 31 of the top part 26 is provided on the inside thereof facing the bottom part 22 with an additional line-up mechanism 30 for accommodating notes or the like, especially for accommodating such paper sheets as do not, like the usual EDP paper sheets, comprise marginal punched holes.

The bottom part 22 of the carrier body or cover 21 is formed with a series of holes 42 which are appropriately disposed along two lines 43 and 45 extending at right angles to one another. These holes 42 function to receive resilient line-up pins or sheet retainers 36 which are inserted into said holes 42.

In one embodiment the line-up pins or sheet retainers 36 are pushed through the holes 42 and will then be supported with their heads 37 on the outside of the bottom part 22, while their leading ends 39 function to receive paper sheets. In another embodiment, which is not illustrated, the line-up pins or sheet retainers may be inserted from inside into the holes 42 and fixed therein, for instance by welding, glueing or threading into a threaded section, e.g. a threaded bush mounted in the respective hole.

The holes 42 may be through-holes or they may be blind holes 42 open to the inside 29 of the bottom part 22 and having a bottom which is formed by webbing 44 provided on the outside 27 of the bottom part 22. To mount the respective line-up pin or sheet retainer, the line-up pin 36 is pushed from outside through said webbing and pushed home until its head 37 abuts the webbing. In this position the line-up pin or sheet retainer will be held in a friction-tight manner, and to this end the line-up pin or sheet retainer 36 may be provided in the vicinity of its head 37 with an area of increased friction so as to prevent undesirable dropping out of the line-up or sheet retainer 36.

In a non-illustrated embodiment, the holes 42 in the bottom part 22 on the outside 27 of the carrier body or cover 21 may be provided with countersunk portions for receiving the respective heads 37, so that the latter will practically not protrude to the outside. The holes 42 along the two lines 43 and 45 are provided at predetermined spacings which correspond to the spacings of the EDP paper sheets. For usual EDP broadside sizes the holes 42 along the line 45 should be arranged such that at least broadside sizes having a width of 305 mm, 315 mm and 322 mm can be accommodated, whereas the holes 42 along the line 43 should be arranged such that at least upright sizes can be accommodated dated which have a short-edge length of 235 mm, 240 mm or 250 mm, while the long-edge length normally is 305 mm.

Figure 2:
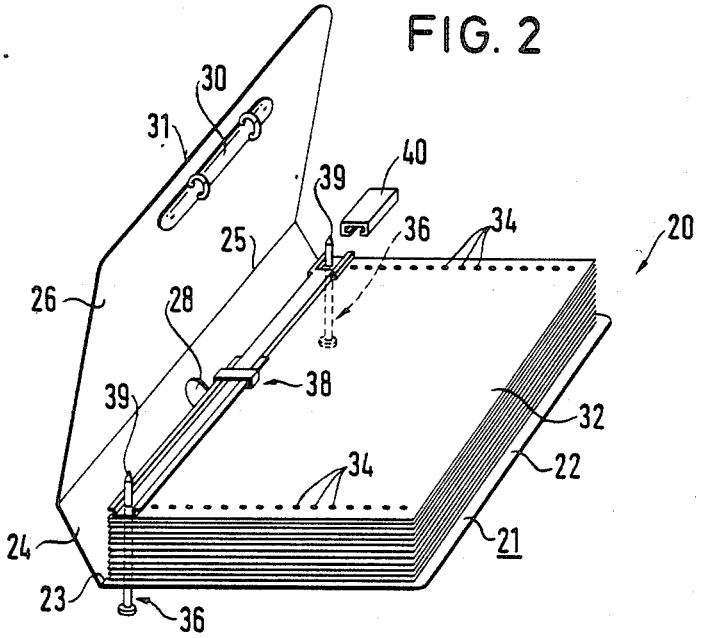
FIG. 2 is a perspective view of a folder according to the invention, in which broadside-size EDP paper sheets are filed.

FIG. 2 shows the accommodation of broadside-size paper sheets 32 having punched holes 34 along two margins. It will be apparent that the stack of paper sheets 32 is received on line-up pins or sheet retainers 36 which pass through punched holes 34 on the inside of the folder 20 and extend through holes in a telescope-type clampin9 bar 38. Furthermore, a slider 40 is indicated which is pushed aver the outer end of the clamping bar 38 to thereby turn down and securely clamp the leading end 39 of the line-up pin 36.

Figure 3:
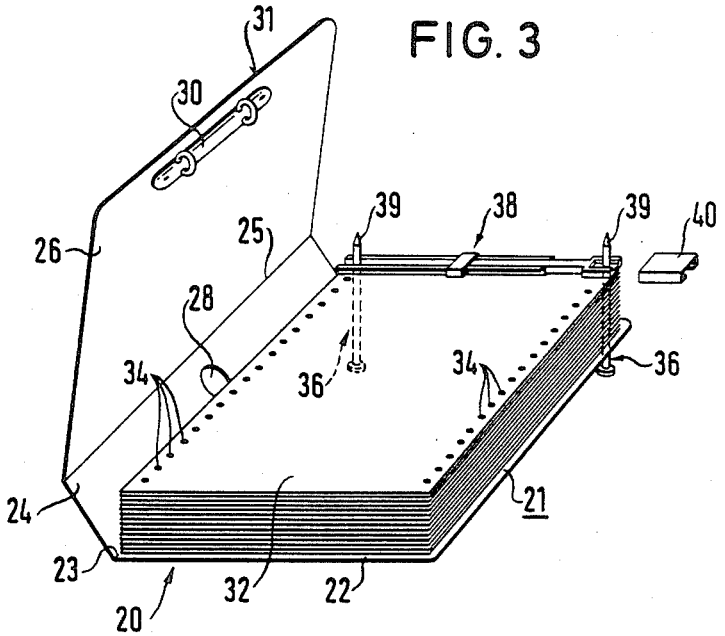
FIG. 3 is a view similar to FIG. 2 and showing a folder according to the invention, in which upright-size EDP paper sheets are filed.
Figure 5:
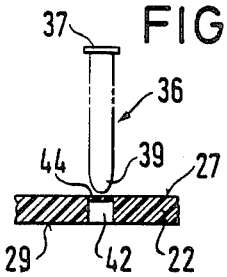
FIG. 5 is a schematic view for explaining the insertion of a line-up pin in a hole in the bottom part.
Figure 4:
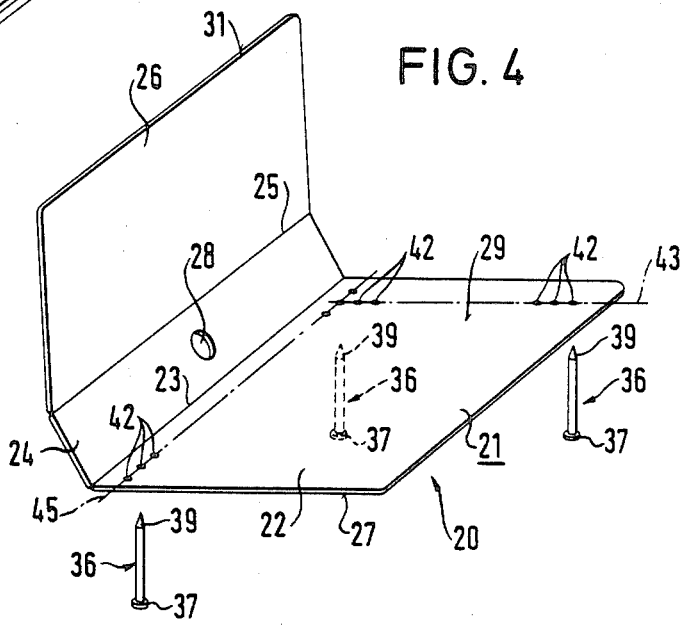
FIG. 4 is a perspective view of a carrier body for the folder according to the invention.

FIG. 3 shows the accommodation of a stack of upright paper sheets 32, wherein punched holes 34 are formed along the longitudinal side of the paper sheets 32. Here, too, the line-up pins or sheet retainers 36 pass through the stack of paper sheets 32 and extend through holes in the telescope-type clamping bar 38 and are securely clamped at the front by a respective slider 40.

It should be noted that either of the embodiments shown in FIG. 2 and FIG. 3 makes use of the same clamping bar 38 whose parts may be telescoped so that the clamping bar 38 can be given the desired length.

Figure 6:
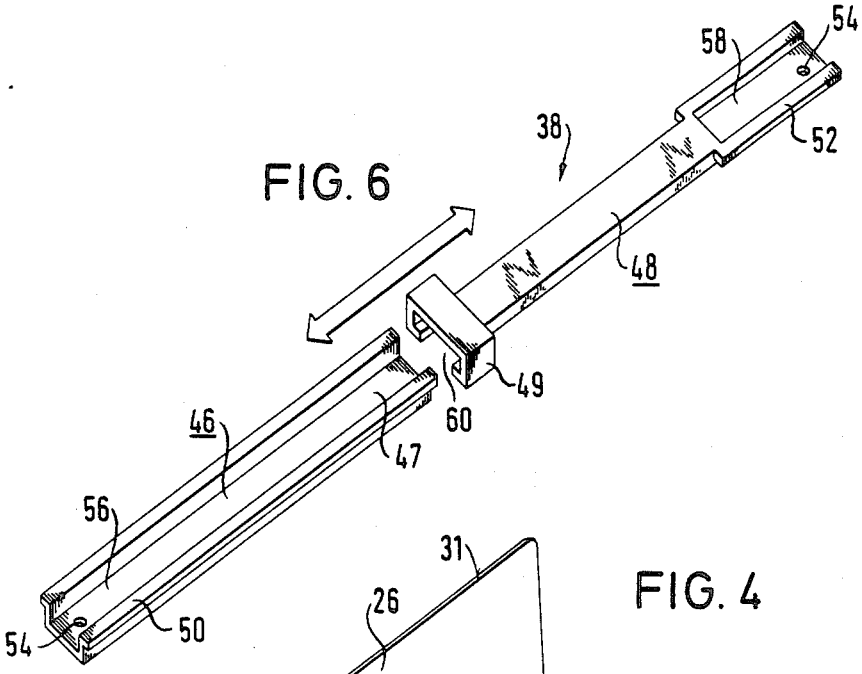
FIG. 6 is a perspective plan view showing a first embodiment of a telescope-type clamping bar for the folder according to the invention.

Details of such a telescope-type clamping bar 38 will be apparent from FIG. 6. Here, the clamping bar 38 merely consists of two portions, viz. a first portion 46 and a second portion 48, the first portion 46 being inserted with a projection 47 thereof into a guide opening 60 constituted by a ring 49. The two ends of the parts 46 and 48 are each provided with only a single through-bore 54 in the bottom thereof, said bore 54 having the function of receiving the leading end 39 of the line-up pin or sheet retainer 36. Furthermore, at least the outer ends of the two parts 46 and 48 are provided with outwardly facing ridges or legs 50 and 52 which in the receiving regions 56 and 58 serve to receive or guide the respective slider 40, which has U-shaped cross-section and engages beneath said ridges 50 and 52 with its inwardly facing legs. The projecting end 39 of the respective line-up pin or sheet retainer 36 will be accommodted in the space between the bottom of the slide 40 and the respective receiving region 56 and 58.

Figure 7:
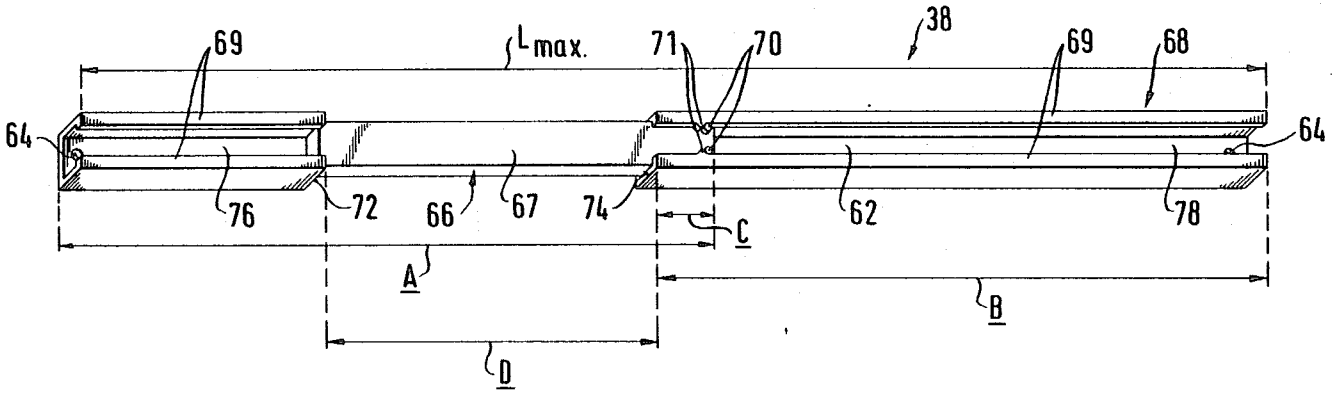
FIG. 7 is a perspective plan view showing a further embodiment of the telescope-type clamping bar in the assembled extended condition.
Figure 8A:
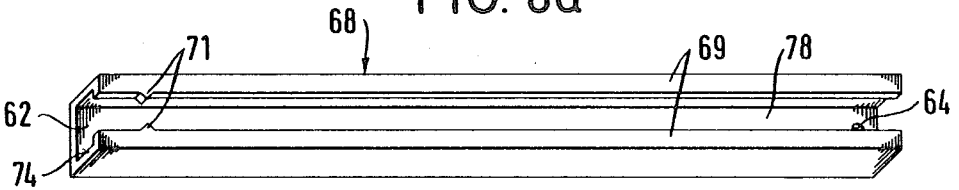
FIG. 8*a* and FIG. 8*b* are perspective views showing the two portions of the telescope-type clamping bar of FIG. 7 in the separated condition.
Figure 8B:
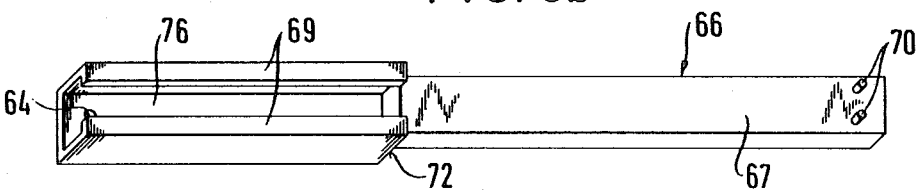
Figure 9:
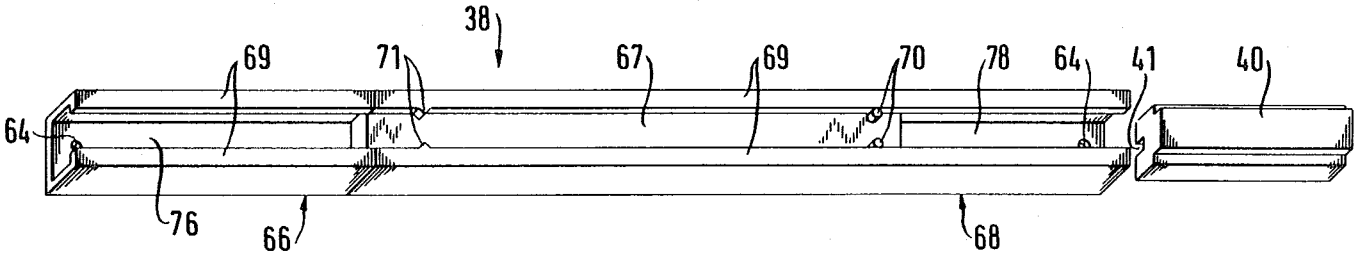
FIG. 9 is a perspective view of the telescope-type clamping bar in the assembled and telescoped condition.

FIGS. 7 to 9 show a further embodiment of the telescope-type clamping bar 38, which comprises a first part 66 and a second part 68. The part 66 has an overall length A, the part 68 has a length B, the minimum area of overlap is indicated at C while D indicates the length by which the part 66 may be inserted with its projection 67 into the guide opening 62 of the part 68.

The one part 66 bears elastic pins or protruberances 70 on its projection 67, while the other part 68 is provided with protruberances 71 disposed in the line of movement of the other protruberances 70 to limit the extent to which the two parts 66 and 68 can be pulled apart. At least the protruberances 70 and, if applicable, also the protruberances 71 are elastic so as to permit initial fitting of the two parts into one another. Suitably, the arrangement is such that the two parts 66 and 68 can be separated from each other only by exertion of a force which must be substantially greater than the force normally exerted to displace the two parts relative to each other. This reliably prevents accidental disengagement of the two parts.

As will be apparent from FIG. 7, the maximum length of the clamping bar 38 is given as $$L_{max} = A + B - C,$$

while the minimum length of the telescope-type clamping bar 38 is given as $$L_{min} = A + B - C - D.$$

The two values for Lmax and Lmin have been chosen such that all values of the usual widths and heights of EDP paper sheets are covered thereby.

Each of the two parts 66 and 68 of the telescope-type clamping bar 38 has a through-bore 64 at the respective outer end of its receiving portion 76 and 78, respectively, said bore being provided to accommodate the leading end of the respective line-up pin or sheet retainer 36. In these receiving portions 76 and 78, the two parts 66 and 68 are configured as U-section members including inwardly facing retaining legs 69 on their top surface and thereby defining a box-like hollow space into which a respective slider 40 may be pushed (see FIG. 9). The slider 40 is provided with a groove 41 on the underside thereof for receiving the leading end 39 of the line-up pin 36. The slider 40 itself is provided on the upper surface thereof with longitudinally extending recesses into which the retaining legs 69 are pushed.

A particularly simple structure will result when, as shown in FIGS. 7 to 9, the one part 68 constitutes a continuous U-section whose guide opening 62 accommodates both the projection 67 of the part 66 and the respective slider 40.

FIGS. 8*a* and 8*b* show the two parts 68 and 66 in the dismantled state, the two relatively displaceable end faces being indicated at 72 and 74. In the extended condition shown in FIG. 7 the end faces 72 have a spacing D from each other, while they abut each other in the telescoped condition shown in FIG. 9.

The bores 54 and 64 in the receiving portions of the telescope-type clamping bar 38 have a spacing from the outer end face of the clamping bar 38 which is equal to the spacing of the punched holes 34 of the paper sheets from their next-adjacent outer edge. With usual EDP paper sheets this spacing is approximately 6 mm. The clamping bar 38 is thereby flush with the stack of paper sheets 32 irrespective of the specific size of paper sheets to be filed.

Irrespective of the specific type of construction, the clamping bar 38 may be flat so that it has little overall height. The respective projection for adjusting the desired length of the clamping bar 38 may be configured as a flat-section member to be inserted into a slot-shaped flat guide means. The clearance for displacement may be in the range of 100 mm, there being sufficient space left at the ends for insertion of the sliders, so that there results a telescope-type clamping bar 38 which covers the marginal lengths of all commonly used quasi-DIN-A4 sizes.

While the invention has been particularly shown and described with respect to preferred embodiments thereof, it will be understood by those skilled in the art that the foregoing and other changes as to form and details may be made therein without departing from the spirit and scope of the invention.

I claim:

1. A folder for paper sheets, especially EDP paper sheets (32) having at least two spaced punched holes (34) at their lateral margins, comprising an integral carrier body or cover (21), a plurality of resilient line-up pins or sheet retainers (36) for accommodating the paper sheets (32) through the punched holes (34), retaining means (38, 40) for securely fixing the line-up pins or sheet retainers (36) and the paper sheets (32), said carrier body or cover (21) being an integral injection moulded part and including a bottom part (22) having an integral connection to a back part (24) and having an integral connection to a top part (26) to form a suitable unit, said bottom part (22) of said carrier body or cover (21) including a first and second plurality of securement holes (42) arranged along first and second lines (43, 45) which are normal to each other, said line-up pins or sheet retainers (36) being removably selectively mounted in said holes for repositioning thereof, and said retaining means (38, 40) including telescope-type clamping bars (38) having means to accommodate the protruding ends (39) of the line-up pins or sheet retainers (36) and are separate from the top part (26).

2. The folder as claimed in claim 1, wherein said integral carrier body (21) is polyolefin material and said retaining means is a polypropylene material.

3. A folder as claimed in claim 1 wherein said line-up pins or sheet retainers (36) are a polyamide material.

4. The folder as claimed in claim 1 wherein said bottom part is a rectangular member and said securement holes (42) are located parallel to at least one edge of said rectangular bottom part (22) and are disposed at a predetermined spacing corresponding to the spacing of the punched holes (34) of EDP paper sheets (32).

5. The folder as claim in claim 1 wherein said securement holes (42) are located in the bottom part (22) of said carrier body or cover (21) as integrally formed blind holes (42) having an outer surface web adapted to be perforated.

6. The folder as claimed in claim 1 wherein said line-up pins or sheet retainers are hail-like having a head and said securement holes (42) are formed in the bottom part (22) having a countersunk portions for receiving a respective head (37) of a line-up pin or sheet retainers (36), and said nail-like line-up pins or sheet retainers (36) having in the vicinity of theheads (37) an area of greater friction for friction-tight insertion into the carrier body or cover (21).

7. The folder as claimed in claim 1 wherein said telescope-type clamping bars (38) include two telescoping injection moulded parts (46, 48; 66, 68), the outer ends of said parts each having a through bore (54, 64) for receiving a line-up pin or sheet retainer (36), a slider (40) slidably mounted on an outer end of said clamping bars for locking the line-up pin or sheet retainer (36) in place.

8. The folder as claimed in claim 1 wherein the telescope-type clamping bars (38) include a first bar (48, 68) having a guide opening (60, 62) and a second bar (46, 66) with a projecting portion (47, 67) slidably mounted in said guide opening and having surfaces in frictional engagement and of complementary cross-section, said first and second bars being relatively displaceable while in said frictional engagement.

9. The folder of claim 8, wherein said guide opening (62) is a through-opening and said projecting portion is a bar-like projection (67) located in the interior of said guide opening.

10. The folder of claim 8, wherein said guide opening (62) is a U-shaped groove provided on the upper surface thereof with inwardly facing retaining legs (69).

11. The folder of claim 8 wherein said guide opening (60) is a ring (49) on said first bar (48) said projecting portion of said second bar being slidably mounted in said ring.

12. The folder as claimed in claim 8 wherein said clamping bars include a pair of first and second U-shaped bar members each defining a guide opening (76, 78) and a second projection member (67), said second bar member includes an outer guide opening corresponding to the guide opening of said first bar member, and at least one slider (40) have the same cross-sectional configuration as said guide opening (78) and slidably mounted therein.

13. The folder as claimed in claim 1, wherein said clamping bars (38) each include at least an elastic protruberance (70, 71) respectively positioned along the same line of movement, said protruberances forming abutments to retain the clamping bar (38) from being pulled completely apart.

14. The folder as claimed claim 1 wherein a first clamping bar (68) of the telescope-type claiming bars (38) is a continuous U-shaped section member on the upper surface thereof with inwardly facing retaining legs (69).

15. The folder as claimed in claim 1 wherein said top part (26) includes a line-up mechanism (30) on an outer edge (31) of its inner side facing said bottom part (22).

* * * * *